US008579205B2

(12) United States Patent
Augusto et al.

(10) Patent No.: US 8,579,205 B2
(45) Date of Patent: Nov. 12, 2013

(54) INTELLIGENT GRID-BASED HVAC SYSTEM

(75) Inventors: Leonardo Rangel Augusto, Campinas (BR); Lucas Goncalves Franco, Campinas (BR); Carlos Eduardo Seo, Campinas (BR)

(73) Assignee: International Business Machines Corporation, Armonk, NY (US)

( * ) Notice: Subject to any disclaimer, the term of this patent is extended or adjusted under 35 U.S.C. 154(b) by 747 days.

(21) Appl. No.: 12/813,825

(22) Filed: Jun. 11, 2010

(65) Prior Publication Data

US 2010/0318226 A1 Dec. 16, 2010

(51) Int. Cl.

| | |
|---|---|
| ***F24D 19/10*** | (2006.01) |
| ***G05D 23/00*** | (2006.01) |
| ***F24F 3/00*** | (2006.01) |
| ***G05B 19/00*** | (2006.01) |

(52) U.S. Cl.
USPC ..... 236/1 B; 236/51; 165/212; 700/277

(58) Field of Classification Search
USPC ..... 236/1 B, 49.3, 49.5, 51; 165/212; 700/277, 278
See application file for complete search history.

(56) References Cited

U.S. PATENT DOCUMENTS

| | | | |
|---|---|---|---|
| 5,156,203 | A | 10/1992 | Funakoshi et al. |
| 6,865,449 | B2 | 3/2005 | Dudley |
| 7,380,279 | B2 | 5/2008 | Prokupets et al. |

FOREIGN PATENT DOCUMENTS

| | | | |
|---|---|---|---|
| JP | 63297954 | A | 12/1988 |

*Primary Examiner* — Chen Wen Jiang
(74) *Attorney, Agent, or Firm* — Nelson and Nelson; Daniel P. Nelson; Alexis V. Nelson

(57) ABSTRACT

An HVAC system includes a grid of intersecting ducts having one or more inlets, outlets, and intersections. Air may be received into the inlets and directed through the outlets into one or more zones of a building. One or more HVAC units may be connected to the inlets and mechanical valves may be located at the intersections to control the air flow through the grid. A control system may be provided to control the temperature of each zone by adjusting the mechanical valves (and/or turning selected HVAC units "on" or "off"). In certain embodiments, the HVAC system includes at least one reading device to read temperature preference information associated with an occupant of a zone. The control system may then align the temperature of the zone with the temperature preference information when the occupant is inside the zone. A corresponding method and apparatus are also disclosed herein.

20 Claims, 7 Drawing Sheets

INTELLIGENT GRID-BASED HVAC SYSTEM

BACKGROUND

1. Field of the Invention

This invention relates to heating, ventilation, and air-conditioning systems, and more particularly to apparatus and methods for improving the efficiency of heating, ventilation, and air-conditioning systems.

2. Background of the Invention

HVAC (heating, ventilation, and air-conditioning) systems are used to create comfortable work and living environments and provide desired climate conditions in temperature- and climate-sensitive areas (e.g., laboratories, animal shelters, food preparation areas, etc.). Many consider HVAC systems to be one of the greatest inventions of the twentieth century. For example, HVAC systems have been instrumental to settling geographic areas where natural climate conditions make the areas uninhabitable or highly uncomfortable to humans.

Unfortunately, the comforts and benefits provided by HVAC systems come with significant costs. Some studies have estimated that up to fifty percent of commercial and residential energy consumption is due to HVAC systems. Not only does this effect a company's bottom line, the energy consumed by HVAC systems becomes even more significant in view of rising energy costs, global warming concerns, and the environmental harm caused by power plants or other mechanisms needed to generate electricity. Thus, advances are needed to improve the efficiency of HVAC systems and thereby mitigate the above-mentioned concerns and problems.

FIG. 1 shows one example of a conventional HVAC system 100 for a building. As shown, the building may include multiple HVAC units 102 (e.g., cooling, heating, or ventilation units 102), each connected to its own isolated duct system 104. Because the duct systems 104 are isolated, certain areas of the building may be unserviceable by certain HVAC units 102. Furthermore, in some cases, only a few rooms or zones along each duct system 104 may be occupied and thus require heating and/or cooling. This may cause many or all of the HVAC units 102 to be turned "on," when a lesser number could theoretically satisfy the heating and/or cooling needs of the building.

In view of the foregoing, what is needed is an improved HVAC system to more efficiently heat and/or cool a building or structure. Ideally, such a system would put more areas of a building within reach of the HVAC units used to heat and/or cool the building. This would ideally allow more HVAC units to be turned off when they are not needed, thereby saving energy. Further needed is an intelligent HVAC system to exclusively deliver heating and/or cooling to areas of a building that are currently occupied. Yet further needed is an intelligent HVAC system to tailor the heating and/or cooling requirements to occupants that are currently in a room or zone of a building.

SUMMARY

The invention has been developed in response to the present state of the art and, in particular, in response to the problems and needs in the art that have not yet been fully solved by currently available apparatus and methods. Accordingly, the invention has been developed to improve the efficiency of heating, ventilation, and air-conditioning systems. The features and advantages of the invention will become more fully apparent from the following description and appended claims, or may be learned by practice of the invention as set forth hereinafter.

Consistent with the foregoing, various embodiments of an HVAC system are disclosed herein. In one embodiment, such a system may include a grid of intersecting ducts. This grid may include one or more inlets, outlets, and intersections. Air may be received into the inlets and directed through the outlets into one or more zones (e.g., rooms, areas, etc.) of a building. One or more HVAC units may be connected to the inlets and mechanical valves may be located at the intersections to control the air flow through the grid. A control system may be provided to control the temperature of each zone by adjusting the mechanical valves (and/or turning selected HVAC units "on" or "off"). In certain embodiments, the HVAC system includes at least one reading device to read temperature preference information associated with the occupant. The control system may then align the temperature of a zone with the temperature preference information when the occupant is inside the zone.

A corresponding method and apparatus are also disclosed and claimed herein.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the embodiments of the invention will be described and explained with additional specificity and detail through use of the accompanying drawings, in which.

DETAILED DESCRIPTION

Figure 1:
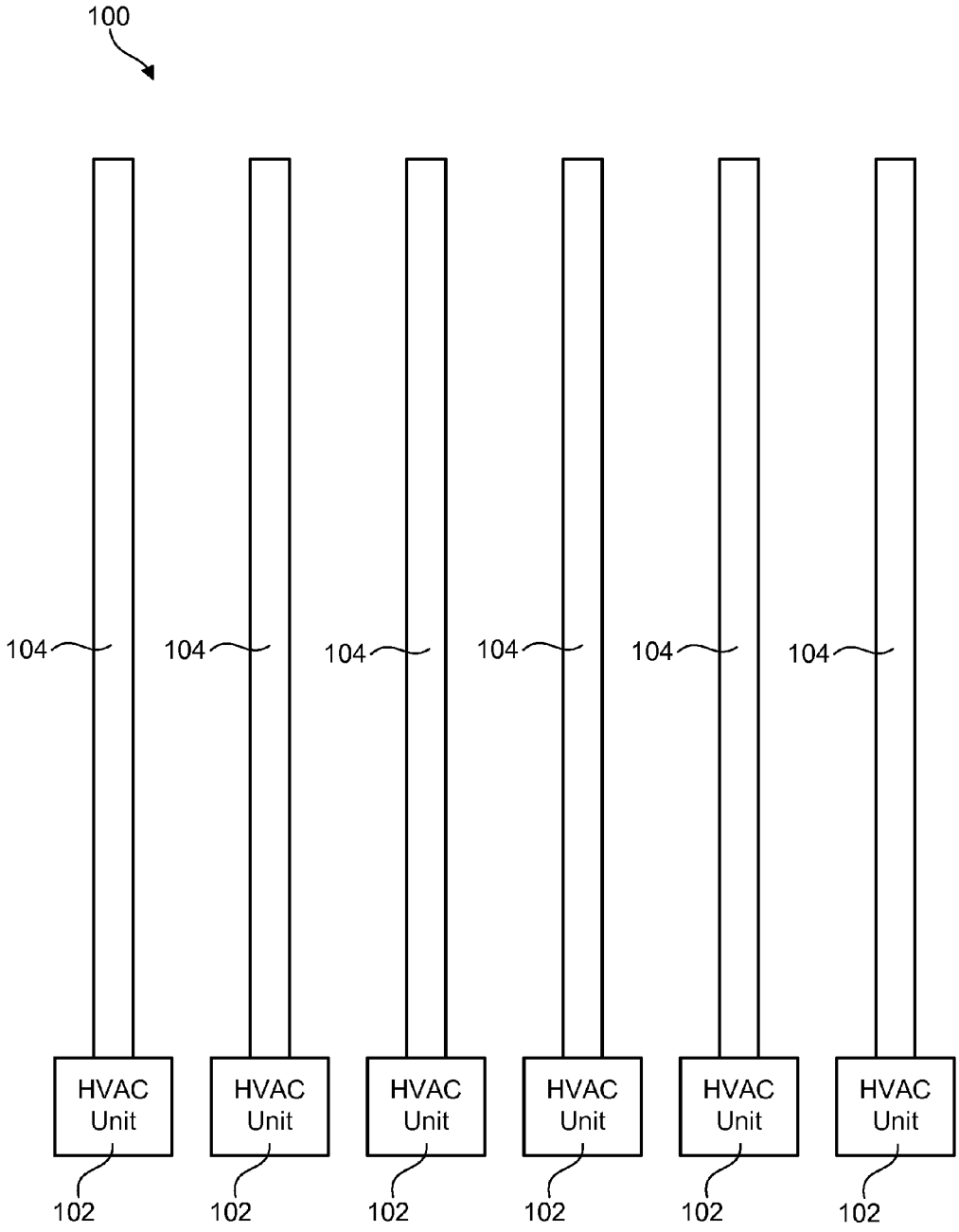
Fig. 1 (Prior Art)
FIG. 1 is a high-level block diagram of a conventional HVAC system.

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

As will be appreciated by one skilled in the art, the present invention may be embodied as an apparatus, system, method, or computer program product. Furthermore, certain aspects of the invention may take the form of a hardware embodiment, a software embodiment (including firmware, resident software, micro-code, etc.) configured to operate hardware, or an embodiment combining software and hardware aspects that may all generally be referred to herein as a "module" or "system." Furthermore, certain aspects of the invention may take the form of a computer program product embodied in any tangible medium of expression having computer-usable program code stored in the medium.

Any combination of one or more computer-usable or computer-readable storage medium(s) may be utilized. The computer-usable or computer-readable storage medium may be, for example but not limited to, an electronic, magnetic, optical, electromagnetic, infrared, or semiconductor system, apparatus, or device. More specific examples (a non-exhaustive list) of the computer-readable storage medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CDROM), an optical storage device, or a magnetic storage device. In the context of this document, a computer-usable or computer-readable storage medium may be any medium that can contain, store, or transport the program for use by or in connection with the instruction execution system, apparatus, or device.

Computer program code for carrying out operations of the present invention may be written in any combination of one or more programming languages, including an object-oriented programming language such as Java, Smalltalk, C++, or the like, and conventional procedural programming languages, such as the "C" programming language or similar programming languages. The program code may execute entirely on a user's computer, partly on a user's computer, as a stand-alone software package, partly on a user's computer and partly on a remote computer, or entirely on a remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The present invention is described below with reference to flowchart illustrations and/or block diagrams of processes, apparatus, systems, and computer program products according to embodiments of the invention. It will be understood that each block of the flowchart illustrations and/or block diagrams, and combinations of blocks in the flowchart illustrations and/or block diagrams, can be implemented by computer program instructions or code. These computer program instructions may be provided to a processor of a general-purpose computer, special-purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable storage medium that can direct a computer or other programmable data processing apparatus to function in a particular manner, such that the instructions stored in the computer-readable storage medium produce an article of manufacture including instruction which implement the function/act specified in the flowchart and/or block diagram block or blocks. The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

Figure 2:
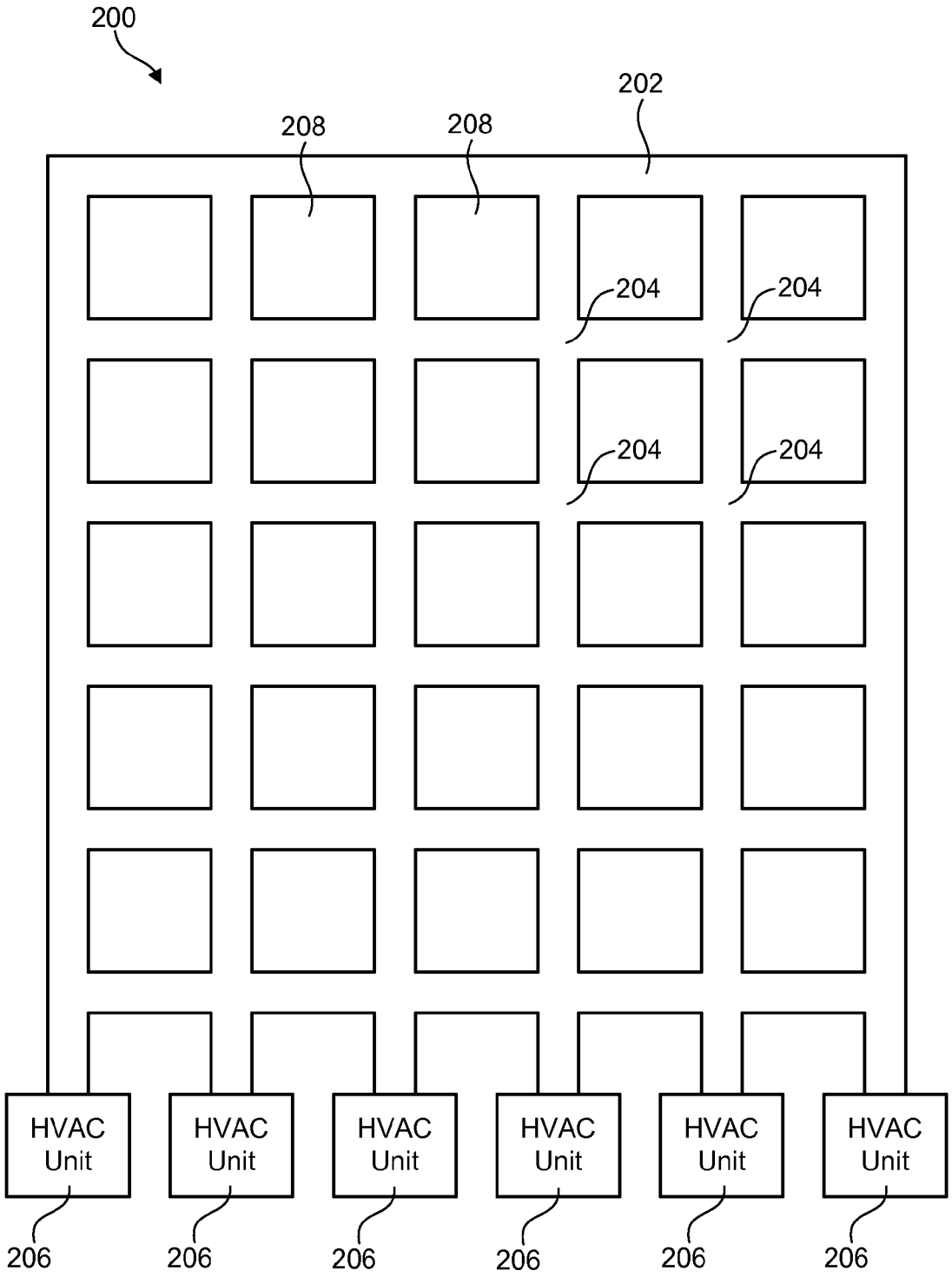
FIG. 2 is a high-level block diagram of a grid-based HVAC system in accordance with the invention.

Referring to FIG. 2, a high-level block diagram showing one example of a grid-based HVAC system 200 is illustrated. The shape and configuration of the illustrated grid-based HVAC system 200 is presented only by way of example and is not intended to be limiting. Indeed, many different configurations, shapes, dimensions, and arrangements of grid elements 208 are possible and within the scope of the invention. In certain embodiments, the grid-based HVAC system 200 is a simple matrix, as illustrated. In other embodiments, the HVAC system 200 assumes other rectangular or non-rectangular configurations containing one or more grid elements 208.

As shown, the grid-based HVAC system 200 includes a grid of intersecting ducts 202. In the illustrated embodiment, the HVAC system 200 includes two sets of parallel ducts that intersect with one another at a right angle to create a grid-like pattern. The grid-like pattern creates intersections where air may be routed in various directions through the grid. For example, air flowing into an intersection 204 may be routed in either a northward, southward, eastward, or westward direction. To route air in a desired direction, mechanical valves (not shown) may be placed at the intersection 204 to control the airflow. This concept will be described in more detail in the Figures to follow.

As shown, the ducts 202 may include one or more inlets to receive airflow from one or more HVAC units 206. The HVAC units 206 may include heating, cooling, or ventilation units 206 that move air through the grid-shaped duct system 202. Certain HVAC units 206 may be turned "on" or "off" depending on a building's requirements for cooling and/or heating. For example, all the HVAC units 206 may be turned on during the hottest part of the day or when the building is fully occupied. Similarly, all or most HVAC units 206 may be turned off at night, when the building is empty, or the outside temperature is such that little heating or cooling is required. In other situations, some subset of the HVAC units 206 may be turned on when some heating or cooling is needed or the building is partially occupied.

The HVAC system 200 includes one or more outlets (not shown) that are directed into one or more zones (i.e., rooms, areas, etc.) of a building. These outlets may be located at various places (or connected to various places) on the grid. For example, the outlets may be located at or connected to the intersections 204 or at points between the intersections 204. As air is directed through the grid, the air will exit through selected outlets into the building. By directing air in a desired manner through the grid (and optionally turning selected HVAC units 206 "on" or "off"), the building may be cooled, heated, or ventilated in a more efficient manner.

Figure 3A:
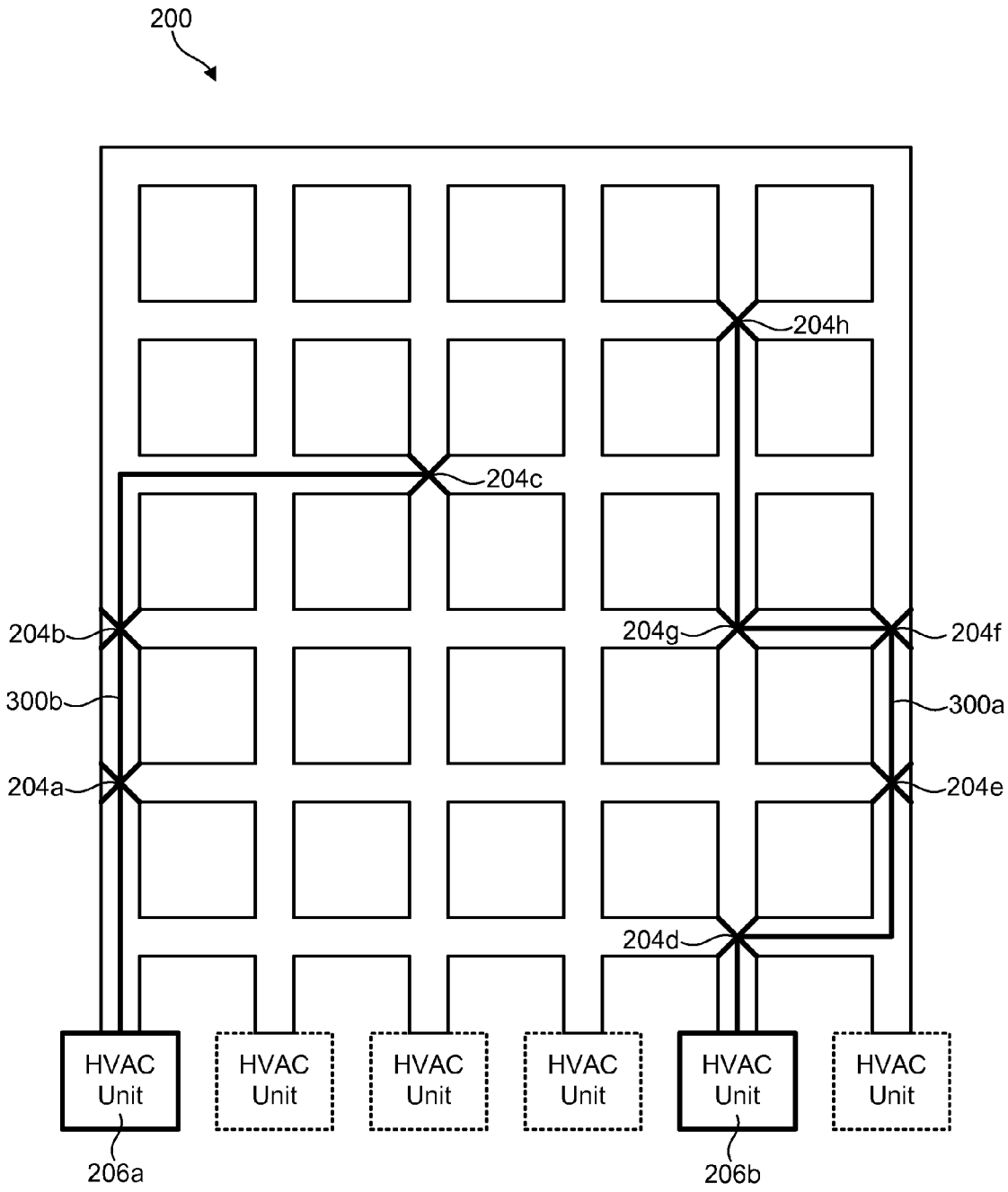
FIG. 3A shows one example of a method for routing air through the grid-based HVAC system of FIG. 2.

Referring to FIG. 3A, one example of a method for routing air through the grid-based HVAC system 200 is illustrated. Assuming an outlet is present at each intersection, suppose that a building requires airflow to each of the intersections 204*a-h* (as marked by an "X") to provide heating or cooling to one or more zones. Further suppose that a pair of HVAC units 206*a*, 206*b* is sufficient to supply the heating or cooling to these zones. Using the mechanical valves at each intersection 204, the following air paths 300*a*, 300*b* may be created. The grid-based HVAC system 200 allows air to be directed along one or more desired paths 300*a*, 300*b* using a minimal or a reduced number of HVAC units 206. Using the conventional HVAC system 100 shown in FIG. 1, four HVAC units 102 would be needed to deliver air to the intersections 204*a-h*.

Figure 3B:
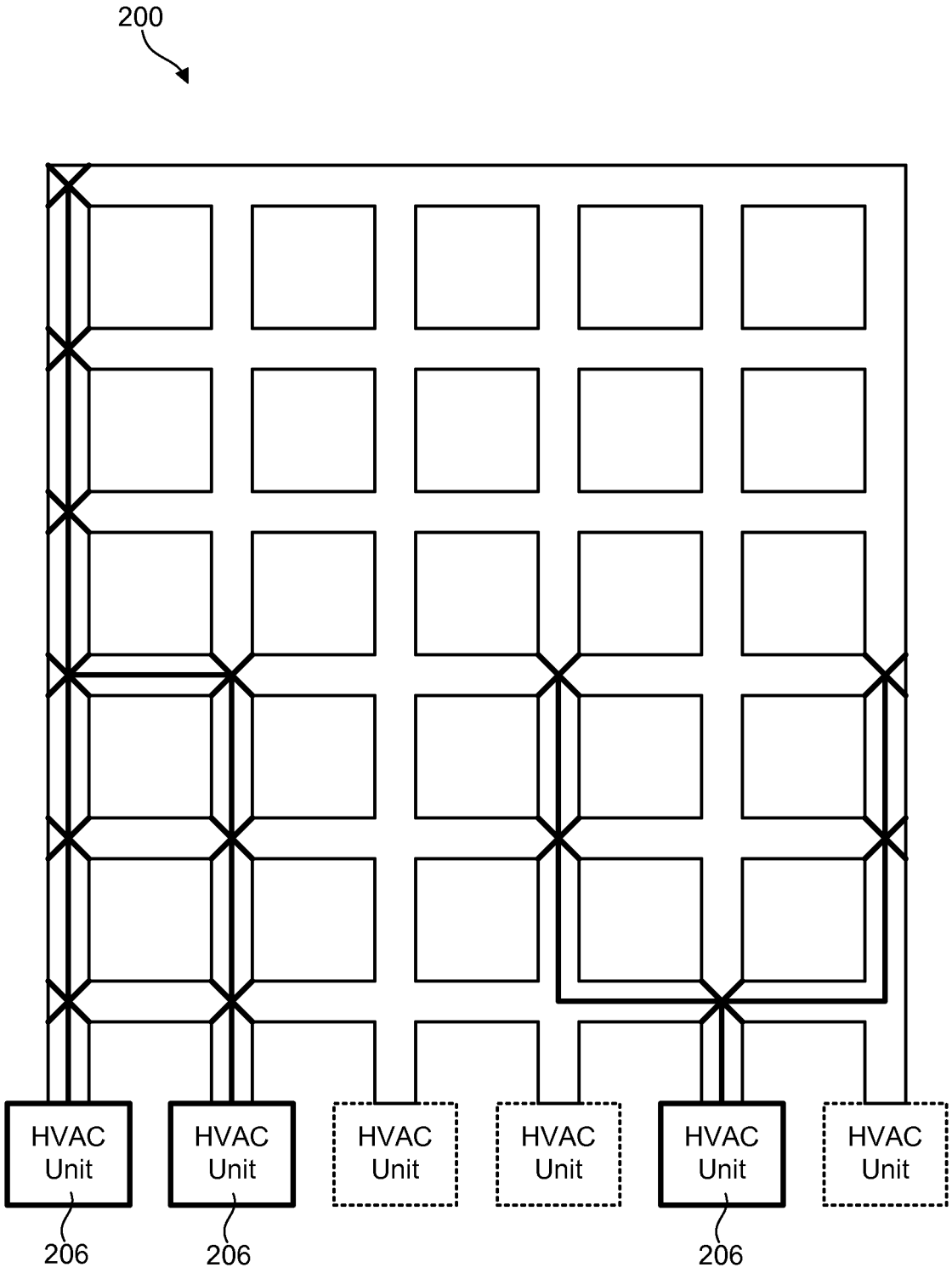
FIG. 3B shows another example of a method for routing air through the grid-based HVAC system of FIG. 2.

Various different algorithms may be used to determine the optimal path or paths through the grid. In certain embodiments, the algorithm may be configured to minimize the length of a path or determine the smallest set of paths that can be used to deliver air to each of the required outlets. The grid-based HVAC system 200 also allows for various different air flow patterns other than those illustrated. For example, air paths associated with different HVAC units 206 may merge together, or a path may branch into multiple air paths, as shown in FIG. 3B. These represent just a few examples of the configurability of the grid-based HVAC system 200 and are not intended to be limiting.

Referring to FIGS. 4A through 4F, one example of a mechanical valve 402 for controlling the air flow through an intersection 204 is illustrated. In this example, each mechanical valve 402 includes four dampers 400*a-d* to control airflow in each of four directions emanating from the intersection 204. In the illustrated example, the dampers 400*a-d* use flat blades or plates to direct air through the intersection 204 although other configurations are also possible. For example, the dampers 400*a-d* may include two-piece butterfly dampers, inflatable dampers, or dampers that have multiple vanes extending across the opening of a duct. In general, the phrase "mechanical valve" is used to encompass any damper or direction mechanism that may be used to regulate and/or control the flow of air through the intersection 204.

Figure 4A:
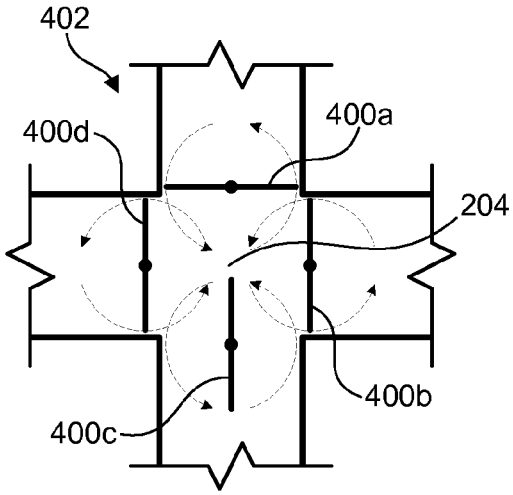
FIGS. 4A through 4F show various examples of mechanical valves for controlling the air flow at the intersections of the grid-based HVAC system.
Figure 4B:
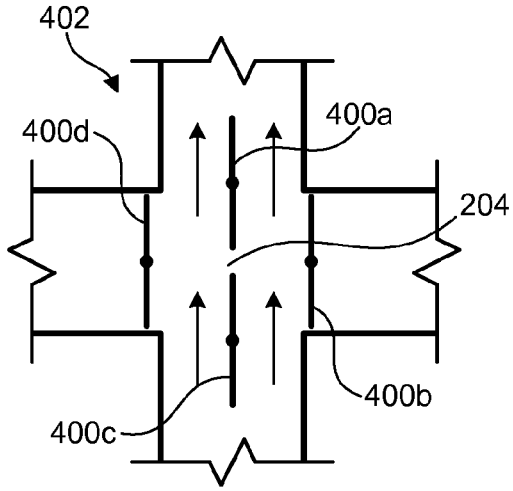
Figure 4C:
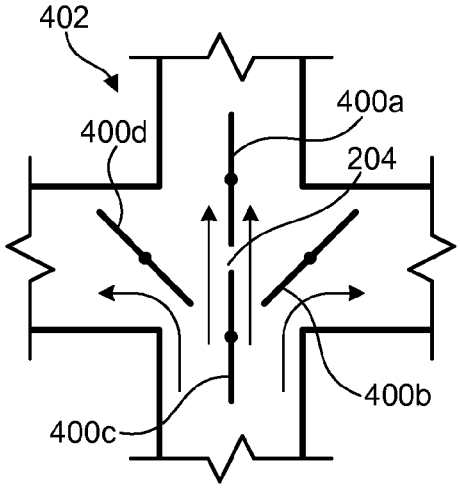
Figure 4D:
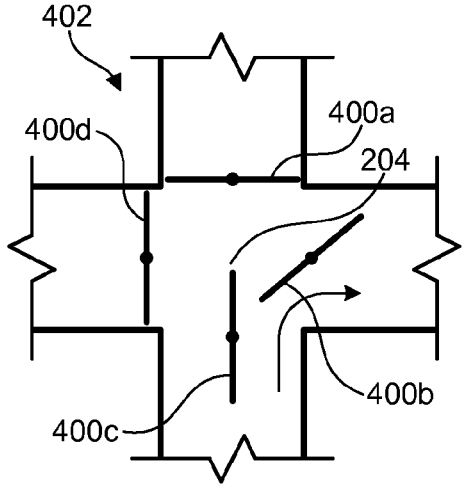
Figure 4E:
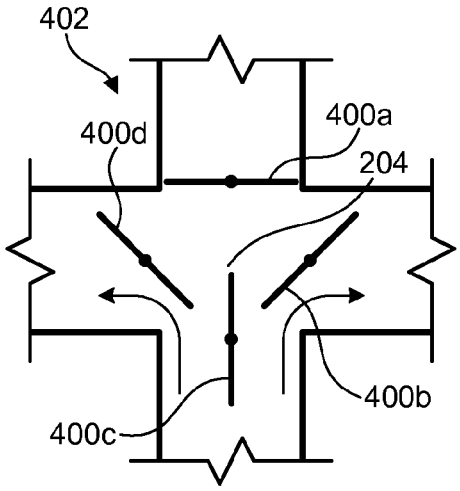
Figure 4F:
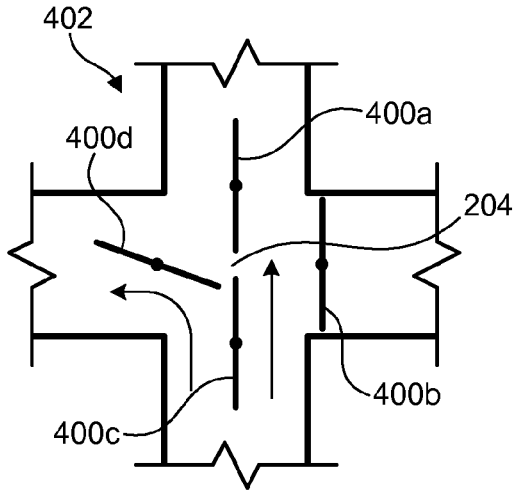

FIG. 4A shows the dampers 400 positioned in a manner to create an endpoint for an air path. In this example, a damper 400*c* is open while the other dampers 400*a*, 400*b*, 400*d* are closed. If the intersection 204 communicates with an outlet, all air traveling into this intersection 204 will be directed through the outlet. FIG. 4B shows the dampers 400*a-d* positioned such that air is directed in a straight line through the intersection without being diverted to either side. FIG. 4C shows the dampers 400*a-d* positioned such that air arriving at the intersection 204 is directed in three directions. This configuration may be used where an air path branches into three different paths. FIG. 4D shows the dampers 400*a-d* positioned such that the airflow takes a right turn at the intersection 204. FIG. 4E shows the dampers 400*a-d* positioned such that the airflow is diverted in both left and right directions, creating a branch in the air path. FIG. 4F shows the dampers 400*a-d* positioned such that the airflow is diverted in both a straight and leftward direction, also creating a branch in the air path. These represent just a few possible configurations for the dampers 400*a-d* and are not intended to be limiting.

Figure 5:
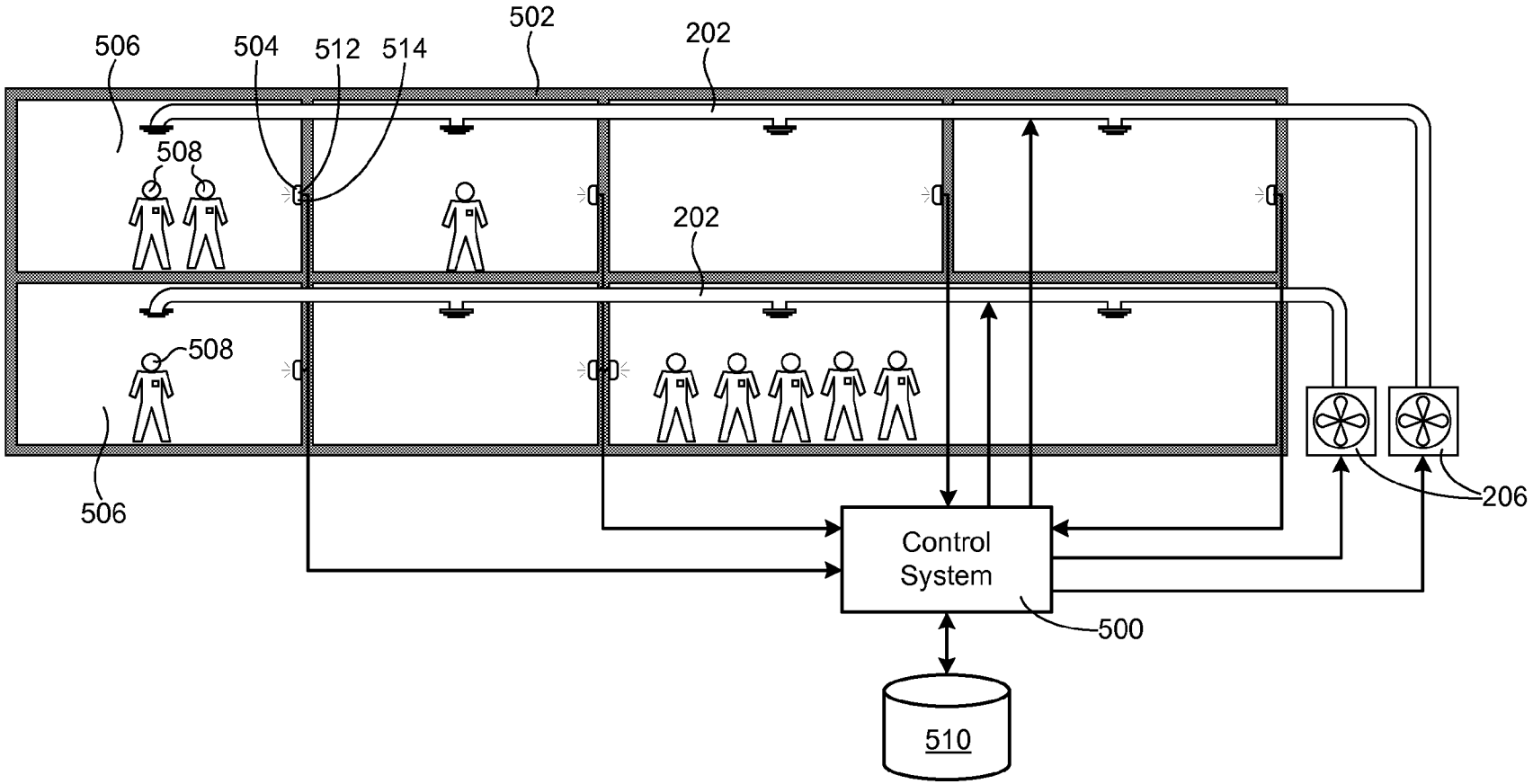
FIG. 5 shows one example of the HVAC system configured to deliver heating and/or cooling to areas of a building that contain occupants.

Referring to FIG. 5, in selected embodiments, an improved HVAC system 200 in accordance with the invention may include a control system 500 to significantly improve its efficiency. The control system 500 may be embodied in a server, dedicated hardware unit, or other computing device, as needed. The control system 500 may be a single device or distributed across several devices. As previously mentioned, many conventional HVAC systems are configured to heat or cool different parts of a building even when no occupants are present. Furthermore, conventional HVAC units and ducting may be configured such that airflow generated by the HVAC units cannot reach many parts of a building. This creates a situation where more HVAC units than are needed are running, wasting energy and causing unnecessary wear and tear on the HVAC units. A control system 500 in accordance with the invention may work in conjunction with the grid-based HVAC system 200 to improve its efficiency and address many of the foregoing problems.

In selected embodiments, a control system 500 in accordance with the invention may receive temperature measurements from various temperature sensors 504 located in various zones of a building 502. For the purposes of this description, a "zone" may include a room, area, space, or other location within the building 502. The control system 500 may compare these temperature measurements with temperature preference information associated with one or more occupants to determine which areas need to be heated and/or cooled.

A reading device 512 (e.g., a card reader, RFID reader, etc.) may read temperature preference information associated with an occupant of the building. The reading device 512 may be located within a zone 506 or in some other area of the building (such as near an entry point of the building). Alternatively, the reading device 512 may be a computer or other device where a user or administrator enters a user's temperature preference information. In selected embodiments, the temperature preference information is read from a readable medium carried by the occupant. For example, the temperature preference information may be read from one or more of a card, tag, or badge carried by the occupant. In certain embodiments, the control system 500 stores the temperature preference information in a data store 510 once it has been read from the readable medium or received from the occupant. In other embodiments, a reading device 512 reads and updates the temperature preference information each time an occupant enters a building 502 or zone 506.

In selected embodiments, a sensor 514 (communicating with the control system 500) may detect whether an occupant is present within a zone 506. For example, when an occupant enters a zone 506, the sensor 514 may detect the occupant's presence and the reading device 512 may read the temperature preference information associated with the occupant. The control system 500 may then heat or cool the zone 506 (e.g., by adjusting the mechanical valves 402 and turning selected HVAC units 206 "on" and "off") until the temperature of the zone 506 aligns with the temperature preference information. The control system 500 may then turn off the air path to that zone 506. When the temperature in the zone 506 rises above a certain threshold (e.g., a few degrees above or below an occupant's preferred temperature), the control system 500 may once again route heated or cooled air to the zone 506 to bring the temperature in line with the occupant's preferred temperature.

Similarly, when an occupant leaves a zone 506, the control system 500 may detect the occupant's absence and cease to heat or cool the zone 506. In this way, the control system 500 may focus heating and cooling resources on zones 506 that contain occupants and ignore or reduce resources dedicated to zones 506 that do not contain occupants, significantly improving efficiency. This system also makes the environment more comfortable to occupants since the system automatically sets room temperature to an occupant's desired level, or to an average temperature that will likely be close to the occupant's desired level.

In selected embodiments, the control system 500 takes into account the temperature preference information of multiple occupants when adjusting the temperature of a zone 506. For example, the control system 500 may average the temperature preference information for each occupant in the zone 506 and heat or cool the zone 506 to correspond to the average. In other embodiments, the control system 500 may use a median temperature value or calculate a temperature value that falls within a temperature range deemed acceptable by each occupant. In other embodiments, each occupant may be assigned a weight value and the control system 500 may give more weight to occupants with a higher weight value. For example, a weight value may be assigned according to a person's hierarchical position within a company or organization (e.g., VPs may have a higher weight value than managers, etc.). In this way, room temperature may be biased toward a more senior or higher ranking member's preference.

As mentioned above, in selected embodiments, the temperature preference information associated with an occupant may include a range of temperature values instead of a single fixed value. In certain embodiments, the average value within this range may be considered the occupant's optimal temperature. Since occupants may tend to have overlapping temperature ranges, in certain embodiments the control system 500 may choose a temperature that falls within each occupant's temperature range.

Figure 6:
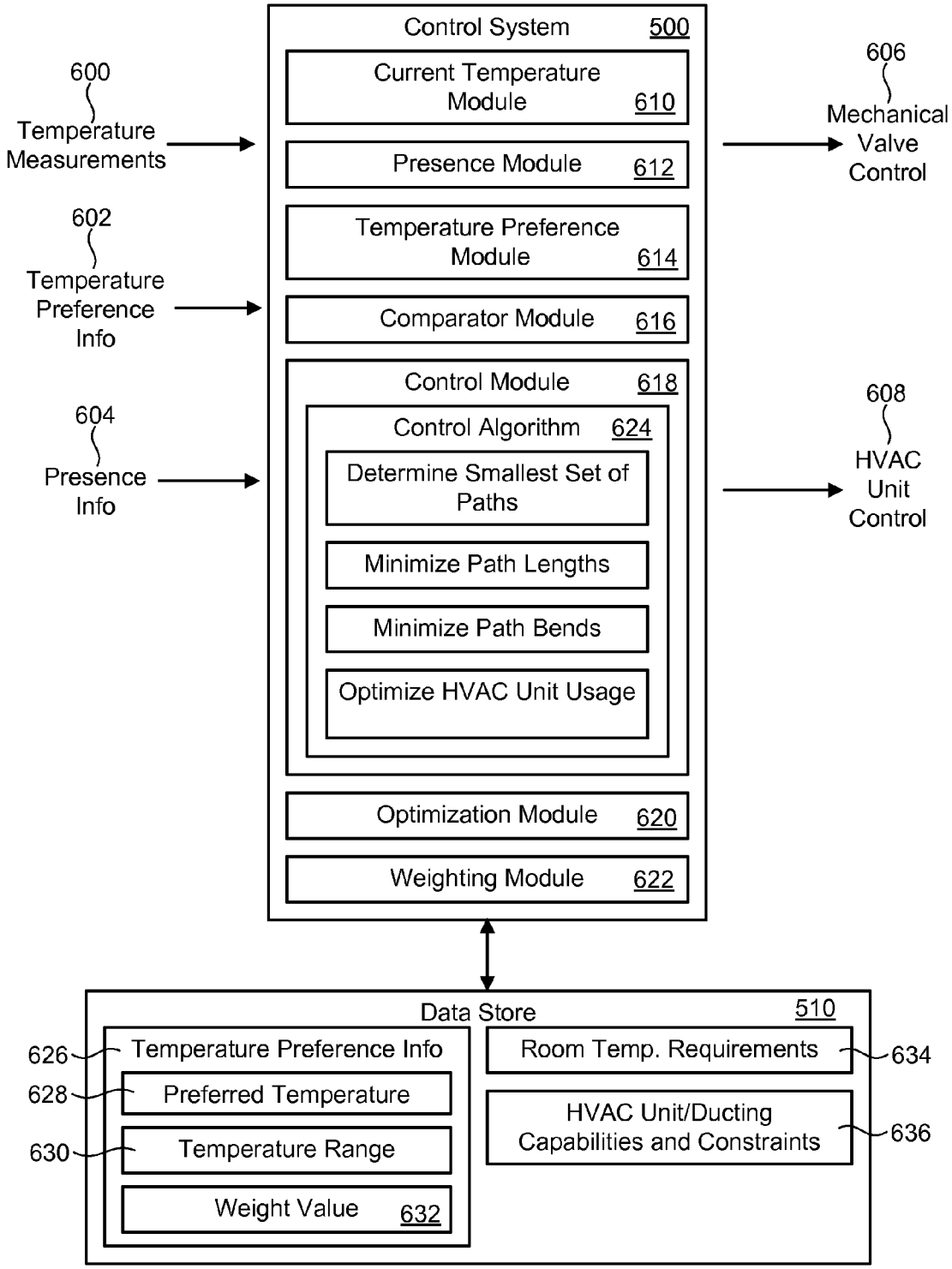
FIG. 6 is a high-level block diagram of one embodiment of a control system for controlling the HVAC system illustrated in FIGS. 2 through 5.

Referring to FIG. 6, one embodiment of a control system 500 is illustrated. In certain embodiments, the control system 500 may be configured to receive temperature measurements 600 from each of the zones 506, temperature preference information 602 associated with one or more occupants, and presence information 604 indicating whether an occupant or occupants are present within a zone 506. Using this information 600, 602, 604, the control system 500 may output control data 606, 608 to the mechanical valves and/or HVAC units 206 to control the airflow through the grid-based HVAC system 200.

In certain embodiments, the control system 500 may include a current temperature module 610, a presence module 612, a temperature preference module 614, a comparator module 616, and a control module 618. These modules may be implemented in hardware, software executable on hardware, firmware, or combinations thereof. The current temperature module 610 may determine the current temperature within a zone 506, such as by receiving current temperature measurements from a temperature sensor 504 within the zone 506. Similarly, the presence module 612 may determine whether one or more occupants are currently in the zone 506 (e.g., using the sensor 514). The temperature preference module 614 may receive temperature preference information for one or more occupants in the zone 506. In certain embodiments, the temperature preference module 614 may receive temperature preference information from a readable medium carried by the occupant. Alternatively, the temperature preference module 614 may receive temperature preference information from a data store 510.

A comparator module 616 may compare the temperature preference information of an occupant with the current temperature of a zone 506. If the current temperature is less than the occupant's preferred temperature, a control module 618 may cause heat to be delivered to the zone 506. If the current temperature is more than the occupant's preferred temperature, the control module 618 may cause cool air to be delivered to the zone 506. In doing so, the control module 618 may determine what actions are needed to heat or cool the zone 506. For example, the control module 618 may determine which mechanical valves 402 should be adjusted and/or which HVAC units 206 should be turned "on" or "off" in order to heat or cool the zone 506.

In determining what actions are needed to heat or cool the zone 506, the control module 618 may execute a control algorithm 624. In certain embodiments, the control algorithm 624 is a graph theory algorithm wherein the HVAC system 200 is viewed as a matrix-shaped graph in which ducts are edges and duct-crossings (i.e., intersections 204) are vertexes. The temperature at each outlet (which may be detected by temperature sensors 504) may be represented by an ever-changing set of "special" vertexes which need to be reached by at least one air path. The graph theory algorithm may be executed each time a change in the set of paths is needed. The set of paths may change, for example, when people enter, exit, or move through a building or zone 506, or when the temperature of a zone 506 falls below or rises above a certain threshold.

In certain embodiments, the execution of the algorithm 624 produces a solution that not only services each zone 506 that needs to be heated or cooled, but also finds the smallest set of paths that can service each zone 506. The algorithm may, in certain embodiments, be restricted by a duct's physical constraints, such as the heat/cool dissipation index, or an HVAC unit's physical constraints, such as its BTU and resulting maximum path length. In certain embodiments, the algorithm 624 may incorporate an equipment usage strategy to optimize or spread usage time over different pieces of equipment. In certain embodiments, the algorithm 624 may be configured to minimize each path's length (i.e., make every path have the shortest possible length) or minimize the number of turns or bends in each path (since bends may increase airflow resistance and lower the efficiency of the HVAC system 200). In general, the algorithm 624 may be configured to take into account the HVAC system's physical capabilities and constraints when determining air paths through the grid. These represent just a few examples of optimizations for the algorithm 624 and are not intended to be limiting.

In certain embodiments, the control system 500 may include an optimization module 620 to optimize the temperature of a zone 506 where multiple occupants are present. For example, the optimization module 620 may average the preferred temperature for each occupant, calculate a median temperature, or calculate a temperature that falls within a range of acceptable temperatures for each occupant. The zone 506 may then be heated or cooled to this optimal temperature. Similarly, if the temperature preference information includes a weight value, a weighting module 622 may allocate more weight to temperature preference information that has a higher weight value. In this way, the weighting module 622 may bias room temperature toward a more senior or higher ranking occupant.

As previously mentioned, the control system 500 may store temperature preference information 626 in a data store 510. This temperature preference information 626 may include, for example, a preferred temperature 628, a range 630 of acceptable temperatures, and potentially a weight value 632. The control module 618 may use these values when adjusting the temperature of a zone 506. In certain embodiments, the control system 500 stores the temperature preference information in the data store 510 instead of repeatedly retrieving it from the occupant. In other embodiments, the control system 500 updates the temperature preference information by retrieving it from the occupant each time he or she enters a building or zone 506.

The data store 510 may store other types of data as needed. For example, the data store 510 may store temperature requirements 634 for each zone 506. For example, a laboratory or other room may need to be heated or cooled to a certain temperature or stay within a temperature range regardless of the occupants that are present in the room. Similarly, a food storage or preparation area may require that its temperature be kept above a certain temperature. The control system 500 may ensure that these room temperature requirements are maintained regardless of whether occupants are in the room.

Similarly, the data store 510 may store data 636 associated with the capabilities or constraints of the HVAC system 200. For example, this data 636 may include a duct's physical constraints, such as the duct's heat/cool dissipation index, or an HVAC unit's physical constraints, such as the HVAC unit's BTU and resulting maximum path length. This data 636 may be used by the control algorithm 624 in computing the optimal path or paths through the grid-based HVAC system 200, as previously explained. Other types of data may also be stored in the data store 510, as needed.

The flowchart and block diagrams in the Figures illustrate the architecture, functionality, and operation of possible implementations of systems, processes, and computer program products according to various embodiments of the present invention. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions.

The invention claimed is:

1. An HVAC system comprising:

a grid of intersecting ducts, the grid comprising a plurality of inlets, outlets, and intersections, wherein each outlet is associated with a zone;

a plurality of HVAC units connected to the inlets;

a plurality of mechanical valves located at the intersections, the mechanical valves configured to control air flow at each of the intersections; and a control system to control the temperature of each zone by adjusting the plurality of mechanical valves.

2. The HVAC system of claim 1, further comprising a reading device configured to read temperature preference information associated with an occupant of the zone.

3. The HVAC system of claim 2, wherein the temperature preference information is stored on a readable medium carried by the occupant.

4. The HVAC system of claim 3, wherein the readable medium is at least one of a card, a tag, and a badge.

5. The HVAC system of claim 3, wherein the control system is configured to control the temperature of a zone by comparing the temperature preference information and the temperature measured for the zone.

6. The HVAC system of claim 5, wherein the control system is configured to control the temperature of a zone by averaging the temperature preference information for each occupant of the zone.

7. The HVAC system of claim 2, wherein the temperature preference information comprises a weight value, and the control system is configured to give more weight to temperature preference information having a higher weight value.

8. The HVAC system of claim 2, wherein the temperature preference information includes a range of acceptable temperatures.

9. The HVAC system of claim 1, wherein the grid is a matrix.

10. The HVAC system of claim 1, wherein the control system is further configured to turn selected HVAC systems on and off to improve the efficiency of the HVAC system.

11. A method for implementing an HVAC system, the method comprising:

establishing a grid of intersecting ducts, the grid comprising a plurality of inlets, outlets, and intersections;

receiving air into the inlets;

directing air from each outlet into a zone;

providing a plurality of mechanical valves at the intersections to regulate the air flow through the grid; and controlling the temperature of each zone by adjusting the mechanical valves.

12. The method of claim 11, further comprising reading temperature preference information associated with an occupant of the zone.

13. The method of claim 12, wherein reading temperature preference information comprises reading from a readable medium carried by the occupant.

14. The method of claim 13, wherein reading from a readable medium comprises reading from at least one of a card, a tag, and a badge.

15. The method of claim 13, further comprising controlling the temperature of each zone by comparing the temperature preference information and the measured temperature for each zone.

16. The method of claim 15, further comprising controlling the temperature of a zone by averaging the temperature preference information for each occupant of the zone.

17. The method of claim 15, further comprising weighting the temperature preference information, and providing more weight to temperature preference information having a higher weight value.

18. An apparatus comprising:

a grid of intersecting ducts, the grid comprising a plurality of inlets, outlets, and intersections, each outlet flowing into a zone;

a plurality of mechanical valves located at the intersections, the mechanical valves controlling the flow of air at the intersections; and a control system to control the temperature of each zone by adjusting the mechanical valves; and the control system further configured to adjust the temperature of each zone to align with temperature preference information received for at least one occupant in the zone.

19. The apparatus of claim 18, wherein the temperature preference information is stored on a readable medium carried by the occupant.

20. The apparatus of claim 18, wherein the control system is configured to adjust the temperature of each zone by averaging the temperature preference information for each occupant in the zone.

* * * * *